United States Patent [19]

Hayek

[11] Patent Number: 5,076,259

[45] Date of Patent: Dec. 31, 1991

[54] CHEST ENCLOSURES FOR VENTILATORS

[75] Inventor: Zamir Hayek, London

[73] Assignee: Dranez Anstalt, Vaduz, Liechtenstein

[21] Appl. No.: 465,417

[22] Filed: Jan. 16, 1990

[30] Foreign Application Priority Data

Jan. 16, 1989 [GB] United Kingdom ..... 8900871

[51] Int. Cl.[5] ..... A61H 31/02

[52] U.S. Cl. ..... 128/30.2; 128/28

[58] Field of Search ..... 450/23; 604/308; 128/30.2, 78, 157, 332, 335, 869, 870, 28

[56] References Cited

U.S. PATENT DOCUMENTS

| | | | |
|---|---|---|---|
| 2,360,476 | 10/1944 | Church | 128/30.2 |
| 3,368,550 | 2/1968 | Glascock | 128/30.2 |
| 4,815,452 | 3/1989 | Hayek | 128/30.2 |

*Primary Examiner*—Richard J. Apley
*Assistant Examiner*—L. Thomas
*Attorney, Agent, or Firm*—Edwin D. Schindler

[57] ABSTRACT

A chest enclosure apparatus is disclosed for use in producing an assisted ventilation of the lungs of a patient when combined with an air oscillator. The chest enclosure includes a chest covering tunnel member made of a stiff, but flexible material. Additionally, a wall member is included at each end of the tunnel member, with each wall member having a concave radially inner periphery for sealing against the front surface of patient's body and being made of an air-impermeable, flexible cushioning material. A band of a flexible, air-impermeable material is provided and extends from each of the longitudinally running edges of the tunnel member for wrapping in a mutually overlapping around the chest region of a patient's back. A fastener is provided for fastening one of the band in order to hold the bands in the overlapping relationship. Finally, an air passageway is provided for the enclosure in order to allow for a connection to a conventional air oscillator.

19 Claims, 2 Drawing Sheets

CHEST ENCLOSURES FOR VENTILATORS

The present invention relates to chest enclosures for use in producing assisted ventilation of the lungs of a patient when combined with an air oscillator.

In medical practice it is frequently necessary to assist the breathing of a patient. Most frequently this is done by intubating the patient and applying periodic positive air pressure through the intubation into the patient's lungs.

Intubation is associated with a number of clinical and practical disadvantages.

The alternative to intubation is to use some form of external ventilator apparatus. Known forms of external ventilator apparatus have suffered from the disadvantages that, if effective, they do not permit the patient any mobility and of high cost.

One known form of external ventilator apparatus is the so-called "iron lung" in which the patient is totally contained from the neck downward. An alternative form of external ventilator apparatus is the so-called "cuirass ventilator" which typically comprises a hard plate to fit against the patient's back and a turtle shell like chest cover which fits over the patient's chest leaving room for expansion of the chest and which is attached to the rear plate, e.g. by straps. The chest cover is intended to seal against the patient's chest and has a padded rim for sealing. Typically, the straps holding the chest cover in place run at the level of the small of the back of the patient well below the axilla.

The chest cover is entirely rigid and proper fitting of the chest cover to a particular patient is a problem. For best results, the chest cover really needs to be tailor-made for the patient.

In order to maintain a satisfactory seal between the chest cover and the patient's body, it is necessary that the patient remains still and lying down.

The rigid nature of the chest cover and the line along which the straps holding the chest cover down on the patient's chest run restrict the movement of the ribs and hence the breathing action produced by the use of the apparatus. This leads to poor efficacy.

The chest covers are normally made from fibreglass and are expensive, particularly if tailor-made for the patient. Each size of fibreglass chest cover will fit only a very restricted range of size of patient. Therefore, to fit patients from the size of babies to large adults, requires a very large number of different chest covers.

Ventilator apparatus of this kind has been available for at least sixty years without being substantially improved to overcome the difficulties set out above.

The present invention provides a chest enclosure for use in producing assisted ventilation of the lungs of a patient, comprising a chest covering tunnel member of stiff but flexible plastics material, a wall member at each end of the tunnel member, each having a concave radially inner periphery for sealing against the front surface of a patient's body and being of air-impermeable, flexible cushioning material, a band of flexible air-impermeable material extending from each of the longitudinally running edges of said tunnel member for wrapping in mutally overlapping relationship around the chest region of a patient's back, means for fastening a said band to hold said bands in said overlapping relationship, and an air passageway into said enclosure for connection in use to an air oscillator.

Preferably, the tunnel member is formed from plastics sheet by bending the sheet into a tunnel shape.

Preferably, one end of the tunnel member (that nearer the patient's neck in use) has a central forwardly extending tongue portion. This places the line of contact against the patient's body as near to the sternum as possible so as to least affect expansion of the rib cage.

Preferably, the plastics material is of from 0.5 to 3 mm thick, more preferably from 0.75 to 2.25 mm thick, e.g. 1 mm or 2 mm thick. Suitably, a thinner plastics material is employed for smaller enclosures. In enclosures for adults, a more substantial thickness of plastics material is appropriate because of the greater area and the greater liability to flex and collapse when partially evacuated.

Suitably, the plastics material is polycarbonate. Alternatively, it may be a plastics material having approximately the same stiffness and flexibility as polycarbonate sheet of from 1 to 2 mm thickness.

Preferably the plastics material is transparent.

The wall members are preferably of closed-cell foam. Preferably each said wall member has a radially outer portion of relatively hard foam material (e.g. neoprene foam) and a radially inner portion of relatively soft foam material (e.g. pvc foam). This provides good cushioning against the patient's body helping to allow free movement of the ribs whilst helping to prevent collapse of the relatively stiff but nonetheless flexible plastics tunnel member without preventing outward or inward flexing of the side wall portions of the tunnel member to accommodate the enclosure to a substantial range of patient sizes.

Preferably, each of said bands is of such a width as to extend from substantially the whole length of each said edge of the tunnel member. Preferably the bands are of closed-cell foam, suitably the same closed-cell foam as is used for the relatively soft closed-cell foam in the prefered form of end wall or foam of similar softness.

One of the said bands is preferably shorter than the other and in use is positioned inside the other.

Preferably, one of said bands is thicker than the other. For instance, the thinner may be approximately 5 mm thick and the other may be approximately 1 cm thick. Preferably, the longer band is the thicker.

Preferably the band which is to be innermost in said overlapping relationship in use is wider at its free end than the outer said band where the outer band overlaps said free end. This may be accomplished by the inner band being of trapeziodal shape with its free end being the wider of its parallel sides and being wider than the outer band. This provides a readily grasped portion of the inner band which is not overlapped by the outer band and which can be held whilst positioning the inner band and the outer band around a patient.

The free end of the outer band is preferably attachable by said fastening means to the opposite side of the tunnel member.

It is particularly prefered that the fastening means acts to apply sealing tension to the outer band generally in line with each end of the tunnel member.

In a suitably sized enclosure, this will result in one sealing band being tensioned approximately beneath the armpits of the patient and the other beneath the diaphragm so that the ribs are left free to expand the chest. This is in distinction to the arrangement in previously known cuirass type apparatus where the ribs are severly constricted by tensioning bands running just above the diaphragm.

Preferably therefore the fastening means include a pair of strap members running generally parallel to one another from side of the tunnel member, each fixed to the outer band and extending therebeyond, and each co-operating with joining means attached to the opposite side of the tunnel member.

The joining means may be VELCRO type pads and co-operating VELCRO type material may be provided on the extending portions of the strap members or the strap members may be entirely of such material. VELCRO is a trademark of the Velcro Corporation for a hook-and-loop fastening system.

By VELCRO, generically, it is meant any releasable and re-usable fabric joining system in which tiny fabric hooks on the surface of one piece of material are joinable to tiny upstanding fabric loops on the co-operating surface of another piece of material.

The invention includes a ventilator for use in producing assisted ventilation of the lungs of a patient comprising such an enclosure together with an air oscillator. The air oscillator may be of any conventional type. In particular, the oscillator may be as described in European Patent Specification No. 0192337 or European Patent Application No. 87901084.1.

The present invention will be illustrated by the following description of a prefered embodiment with reference to the accompanying drawings in which:

FIG. 3 is a plan view of the enclosure of FIGS. 1 and 2 in an opened condition.

Figure 1:
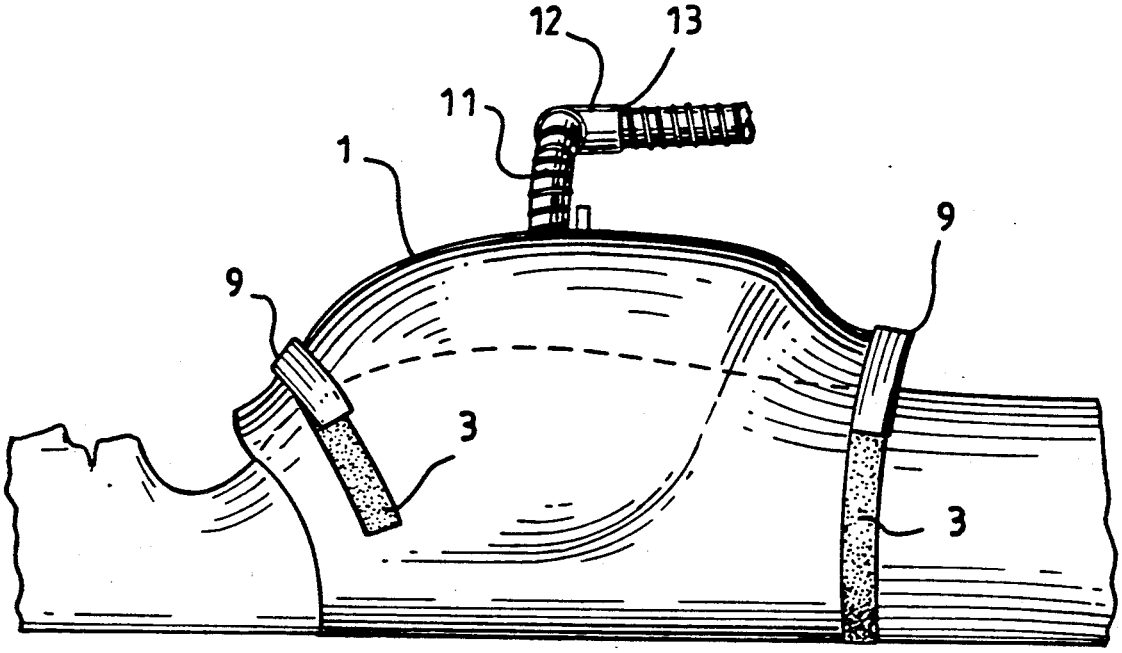
FIG. 1 is a side elevation of an enclosure according to the invention.
Figure 2:
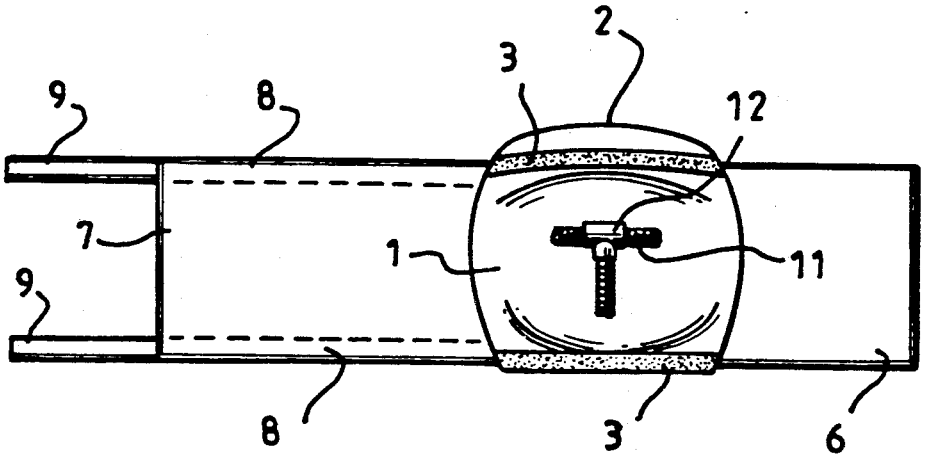
FIG. 2A is a top end elevation of the enclosure of FIG. 1.
FIG. 2B is a bottom end elevation of the same enclosure.
Figure 2A:
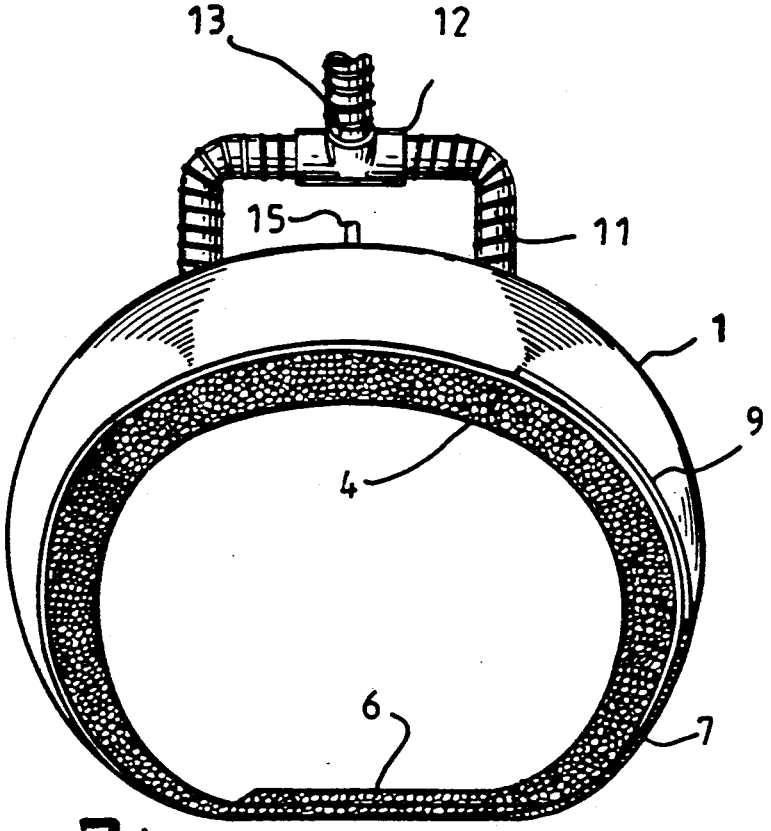
Figure 2B:
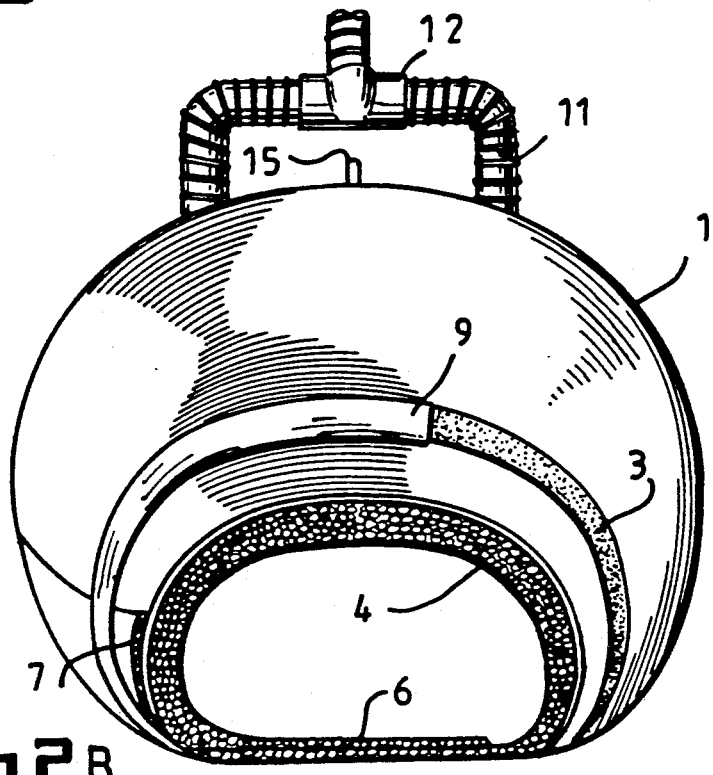

As shown in FIG. 1, an enclosure according to the invention comprises a tunnel 1 of polycarbonate sheet 1 mm thick, formed by curving a flat sheet of polycarbonate into a generally hemicylindrical shape. Prior to the sheet being bent into the tunnel shape, it is cut to provide a forwardly protruding tongue 2.

At each end of the tunnel member 1 is secured by adhesive a generally crescent shaped piece of dense, comparitively hard, closed-cell foam 3 which extends slightly beyond the edges of the tunnel member. At each end of the tunnel member, to the interior face of the crescent of hard foam 3, is secured a crescent shaped piece of softer closed cell foam 4 which extends beyond the ends of the harder foam crescent 3.

The softer and harder foams may be secured together by adhesive. Preferably, the adhesive is such that the two foam layers can be separated without damage to the harder foam layer. The softer foam layer may be replaceable. Preferably, the softer foam layer is made from foam sheets of the kind in which a layer of adhesive is provided covered by a release sheet which is removable to expose the adhesive.

A pair of male VELCRO (i.e., the loop portion of the hook-loop fastening means known by the trademark VELCRO) pads 5 are provided on the outer surface of the tunnel member running from one longitudinal free edge up towards the apex of the tunnel shape. One runs directly adjacent the square cut end of the tunnel member. The other runs parallel from the opposite bottom corner of the tunnel member behind the protruding tongue portion 2.

A slightly trapeziodal shaped wide band 6 of soft foam material of a closed-cell type is secured along the free edge of the tunnel member beneath the pads 5. The narrower end of the band is secured to the tunnel member and the wider end is free.

The thickness of the foam material employed for this band is about 0.5 cm.

Extending from the opposite free longitudinal edge of the tunnel member is a longer and thicker band 7 of similar closed-cell foam material, e.g. about 1 cm thick which is of rectangular shape and of a width corresponding to that of the smaller end of band 6.

Parallel strips 8 of female VELCRO material are secured by adhesive to the tunnel member and along each long edge of the band 7 and portions 9 of each strip 8 extend from the free end of the band 7.

Toward the square cut end of the tunnel member 1 symetrically disposed about the longitudinal mid-line thereof are provided a pair of apertures 10 into which are pushed the ends of respective rubber tubes 11 which are joined by a T-piece 12 to provide an inlet/outlet 13 for connection to an air oscillator. A small aperture 14 is provided in the tunnel member in the mid-line thereof to allow the introduction of a tube 15 for monitoring the air pressure in the enclosure in use.

The manner of use of the enclosure described is as follows. The tunnel member is placed over the chest of the patient with the tongue portion 2 toward the patient's chin. That end of the enclosure should lie over the patient's sternum and the opposite end should lie below the patient's diaphragm. The shorter band 6 is pulled across the patient's back and the longer band 7 is pulled over the shorter band 6. The shorter band 6 can easily be gripped by virtue of its trapeziodal shape. Suitable tension is applied and the velcro type fastenings 9 and 5 are connected together. The ends of the crescent shape of foam 4 should extend far enough to lie against the patient's back.

The inlet/outlet 13 is then connected to an air oscillator which is operated to ventilate the patient's lungs.

The enclosure described offers a substantial number of advantages over those previously employed.

Because of the manner of its construction it will be far less expensive to produce than the fibreglass shell type cuirass ventilator apparatus previously known.

Because of the lateral flexibility of the tunnel member, each size of enclosure can fit a much wider range or patient sizes so that fewer sizes of enclosure need to be produced.

By virtue of the large depth of foam in each end wall, and the flexibility of the tunnel member the patient is rendered mobile and an adequate airtight seal will not be lost through reasonable patient movement.

The patient can be dressed when using the apparatus but if desired, for instance because there has been contact with the patient's skin, the soft foam lining of the end wall members can easily be replaced when one patient has finished with the enclosure.

The transparent material employed in the preferred embodiment enables the patient's chest to be seen where this is desirable and is X-ray transparent.

The enclosure can very rapidly be placed on a patient and is sufficiently simple to attach for a patient of competent age to be able to put on himself. Therefore, the apparatus is not restricted to use in hospitals but will be suitable for use by patients at home who may obtain significant benefit in some medical conditions from using the ventilator for a limited period during a day.

The flexibility of the tunnel member is such that whilst it will resist the forces produced by partial evacuation in use, it is still possible to apply cardiac massage through the enclosure.

Whilst the invention has been described with reference to the illustrated embodiment, many modifications and variations thereof are possible within the scope of the invention.

The invention includes a method comprising using the apparatus described in ventilating a patient.

I claim:

1. A chest enclosure for use in producing assisted ventilation of the lungs of a patient, comprising a chest covering tunnel member of a stiff, but flexible plastic material, a wall member at each end of the tunnel member, having a concave radially inner periphery for sealing against the front surface of a patient's body and being of an air-impremeable, flexible cushioning material, one or more bands of flexible, air-impermeable material extending from each longitudinally running edge of said tunnel member for wrapping in mutually overlapping relationship around the chest region of a patient's back, means for fastening at least one of said bands to hold said bands in said overlapping relationship, and an air passageway into said enclosure for connection in use to an air oscillator.

2. An enclosure according to claim 1, wherein the tunnel member is formed from plastics sheet by bending.

3. An enclosure according to claim 1, wherein the end of the tunnel member nearer the patient's neck in use has a central forwardly extending tongue portion.

4. An enclosure according to claim 1, wherein said plastics material is from 0.5 to 3 mm thick.

5. An enclosure as claimed in claim 1, wherein one of said bands is shorter than the other and wherein one of said bands is thicker than the other, wherein the longer band is the thicker one and, wherein said fastening means acts to apply sealing tension to said outer band generally in line with each end of the tunnel members.

6. An enclosure as claimed in claim 5 wherein said fastening means includes a pair of strap members running generally parallel to one another from one side of the tunnel member, each fixed to the outer band and extending therebeyond, and each co-operating with joining means attached to the opposite side of said tunnel member, and wherein said joining means are hook and loop type VELCRO pads and co-operating hook and loop type VELCRO material is provided on said strap members.

7. An enclosure as claimed in claim 1, wherein said plastic material is polycarbonate.

8. An enclosure as claimed in claim 1, wherein said plastic material is transparent.

9. An enclosure as claimed in claim 1, wherein said tunnel member is transparent.

10. An enclosure as claimed in claim 1, wherein said wall members are of closed-cell foam.

11. An enclosure as claimed in claim 10, wherein said wall members each have a radially outer portion of relatively hard foam material and a radially inner portion of relatively soft foam material.

12. An enclosure as claimed in claim 1, wherein each of said bands has a width which is substantially equal to the entire length of each edge of said tunnel member.

13. An enclosure as claimed in claim 12, wherein said bands are of closed-cell foam.

14. An enclosure as claimed in claim 1, wherein two of said bands are utilized and one of said bands is shorter than the other.

15. An enclosure as claimed in claim 1, wherein two of said bands are utilized and one of said bands is thicker than the other.

16. An enclosure as claimed in claim 15, wherein said thicker band is the longer of said two bands.

17. An enclosure as claimed in claim 1, wherein a plurality of said bands are utilized wherein one band is innermost and a second band is outermost in which the innermost band is in said overlapping relationship in use and is wider at its free end than the outer said band wherein the outer band overlaps said free end.

18. An enclosure as claimed in claim 17, wherein the free end of said outer band is attachable by said fastening means to an opposite side of said tunnel member.

19. An enclosure as claimed in claim 18, wherein said fastening means acts to apply a sealing tension to said outer band substantially in line with each end of said tunnel member.

* * * * *